US005911299A

United States Patent [19]

Aspnes et al.

[11] Patent Number: 5,911,299

[45] Date of Patent: Jun. 15, 1999

[54] VENDING MACHINE WITH COIN ENTERTAINMENT

[75] Inventors: Ronald W. Aspnes; Russell W. Blundy, both of Bloomington, Minn.

[73] Assignee: GGB Tech., Inc., Bloomington, Minn.

[21] Appl. No.: 08/756,781

[22] Filed: Nov. 26, 1996

[51] Int. Cl.[6] ..... G07F 1/04; G07F 11/44

[52] U.S. Cl. ..... 194/344; 194/352

[58] Field of Search ..... 194/352, 350, 194/344; 221/24

[56] References Cited

U.S. PATENT DOCUMENTS

| | | | |
|---|---|---|---|
| 1,572,090 | 2/1926 | Smith | 194/352 X |
| 4,682,709 | 7/1987 | Brandes et al. | 221/2 |
| 4,871,055 | 10/1989 | Polythress et al. | 194/352 X |
| 5,111,928 | 5/1992 | Kovens | 194/292 |

FOREIGN PATENT DOCUMENTS

| | | | |
|---|---|---|---|
| 3134178 | 3/1983 | Germany | 194/344 |

*Primary Examiner*—F. J. Bartuska

[57] ABSTRACT

An aerobatic coin vending machine where the coin travels an aerobatic path under the influence of gravity after being fed into the coin feed mechanism. The coin first drops into a pre-chute with a relatively wide mouth for catching the coin. The pre-chute then drops the coin into the mouth of a main chute having a pair of first and second track portions. The coin rolls down the first track portion in one axial direction of the coin and then drops into the second track portion, down which it rolls in the other axial direction of the coin. The coin then drops out of the coin outlet of the main chute and onto a trackless and endless structure or vortex structure where the coin rolls in a spiral. Finally, the coin falls into a coin container. The main chute and vortex structure are disposed in the vending machine behind a transparent sidewall of the vending machine so that the coin aerobatics may be observed. An opaque inclined piece between the outlet of the vortex and the coin container prevents the interior of the coin container from being viewed through the transparent sidewall. The vortex structure is formed of a clear material and a design or color is applied to a surface of the vortex structure opposite of the surface on which the coin rolls such that the aesthetic surface is spared the effects of the dirty, cutting effects of a fluted coin such as a quarter. A method of collecting coins includes rolling a coin down track and trackless portions and rolling the coin in opposite axial directions of the coin.

17 Claims, 6 Drawing Sheets

VENDING MACHINE WITH COIN ENTERTAINMENT

BACKGROUND OF THE INVENTION

The present invention relates generally to vending machines, particularly to coin-fed vending machines, and specifically to vending machines offering entertainment such as with the coin performing aerobatics after it is fed into the machine.

A gumball machine may be more profitable if the machine provides entertainment as well as a gumball. For example, one popular gumball machine includes a long spiral track from the gumball container to the gumball outlet so that the customer may be entertained by the gumball traveling the long spiral track. Unfortunately, such a gumball machine is problematic. One problem is that the relatively long track is difficult to clean. Another problem is that nonspherical or packaged articles are difficult if not impossible to dispense in a rolling manner down the spiral track. Hence, such a machine is limited perhaps to a round article such as the gumball or jawbreaker. Still another problem is that the gumball or other round candy is relatively light and thus fails to gather speed of a sufficiently great rate so as to be of sufficient entertainment value.

SUMMARY OF THE INVENTION

A general object of the present invention is to provide a unique coin fed vending machine.

Another object of the invention is to provide a vending machine where the coin instead of the gumball performs a unique entertaining act. Specifically, after being fed into a coin feed mechanism, the coin gathers speed quickly down a chute which orientates the coin for rolling in a spiral fashion at first slowly and then ever faster down a vortex.

Another object of the invention is to provide a unique chute. The chute includes a relatively wide mouth as the coin inlet for catching the coin being dropped from the coin feed mechanism. The chute also includes first and second track portions on which the coin rolls in respective opposite axial directions of the coin. The outlet of the chute orients the coin at generally a right angle relative to the initial portion of the vortex surface.

Another object of the invention is to provide a vending machine which uniquely includes both a clear or transparent housing portion for observing the aerobatics of the coin and a clear or transparent chute for viewing the coin before the coin drops onto the vortex.

Another object of the invention is to provide a unique piece adjacent to the outlet of the vortex. The piece is opaque and covers the vortex outlet to hide the interior of the coin collector, which may be full of a relatively great number of coins. The opaque piece is spaced from the vortex outlet and includes an inclined surface such that a coin dropping from the vortex outlet may slide into the coin container.

Another object of the invention is to utilize a coin feed mechanism which uniquely permits coins of a lesser value to be fed through the coin feed mechanism without the dispensing of an article. Such permits, for example, a parent to appease a demanding child by giving the child a penny. The penny provides entertainment for the child without providing candy to the child.

Another object of the invention is to provide a unique vortex structure. The structure is formed of a clear material and has a design or color applied to the surface opposite of that upon which the coin rolls to spare the design or color from the dirtying and cutting effects of a coin. Without the coin rolling surface having a design or formed from a solid colored material, the coin rolling surface may be cleaned more often and with harsher detergents.

Advantageously, the present vending machine is profitable, provides entertainment, requires little cleaning, may be cleaned with harsh chemicals, is sanitary, may be used with a great variety of articles, provides entertainment for a relatively great amount of time, and provides entertainment with or without the dispensing of an article.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where.

Figure 1:
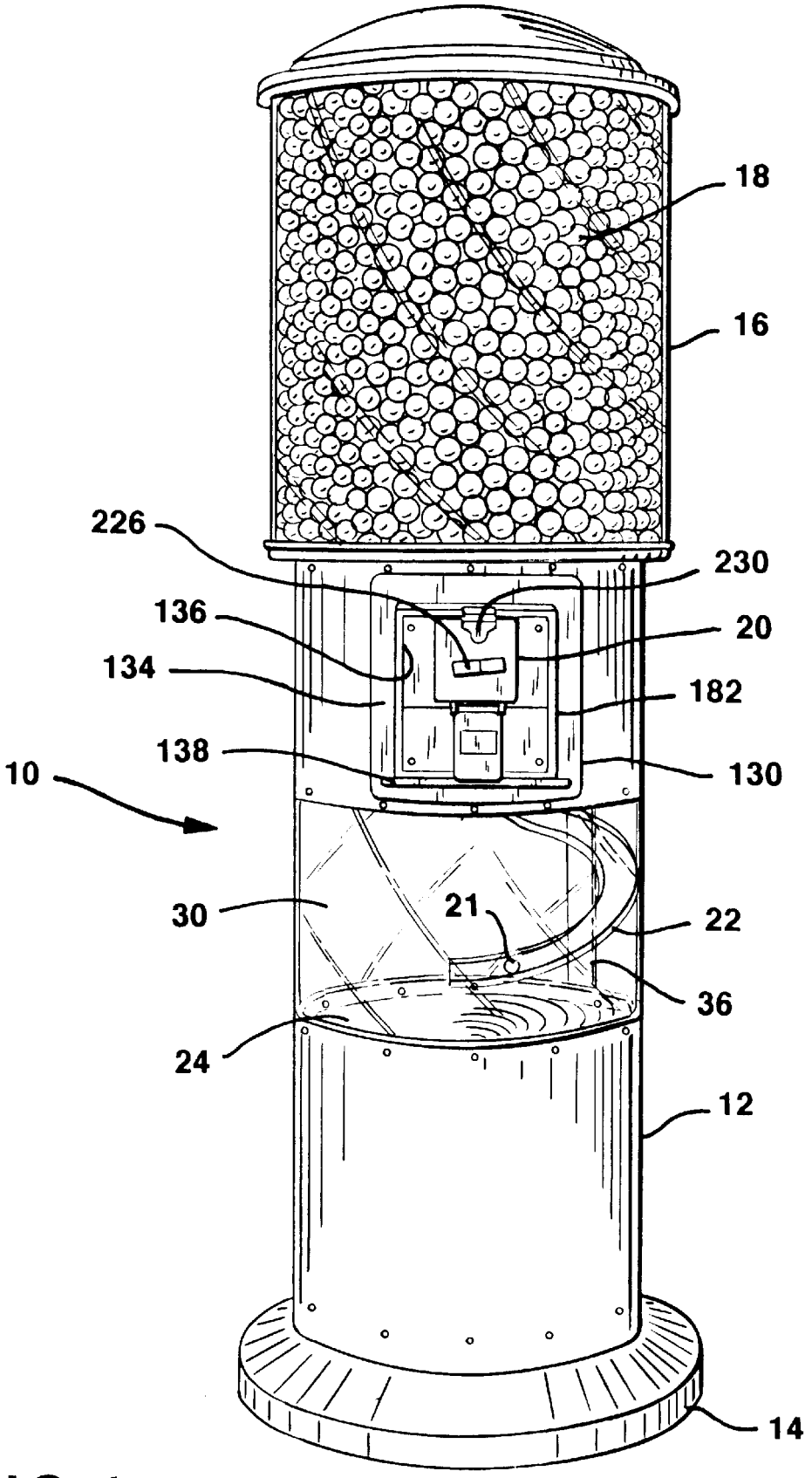
FIG. 1 shows a front perspective view of the present vending machine.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "inner", and "outer", and similar terms are used herein, it should be understood that these terms have reference only to the structure shown in the drawings as it would appear to a person viewing the drawings and are utilized only to facilitate describing the preferred embodiments.

DESCRIPTION

Figure 2:
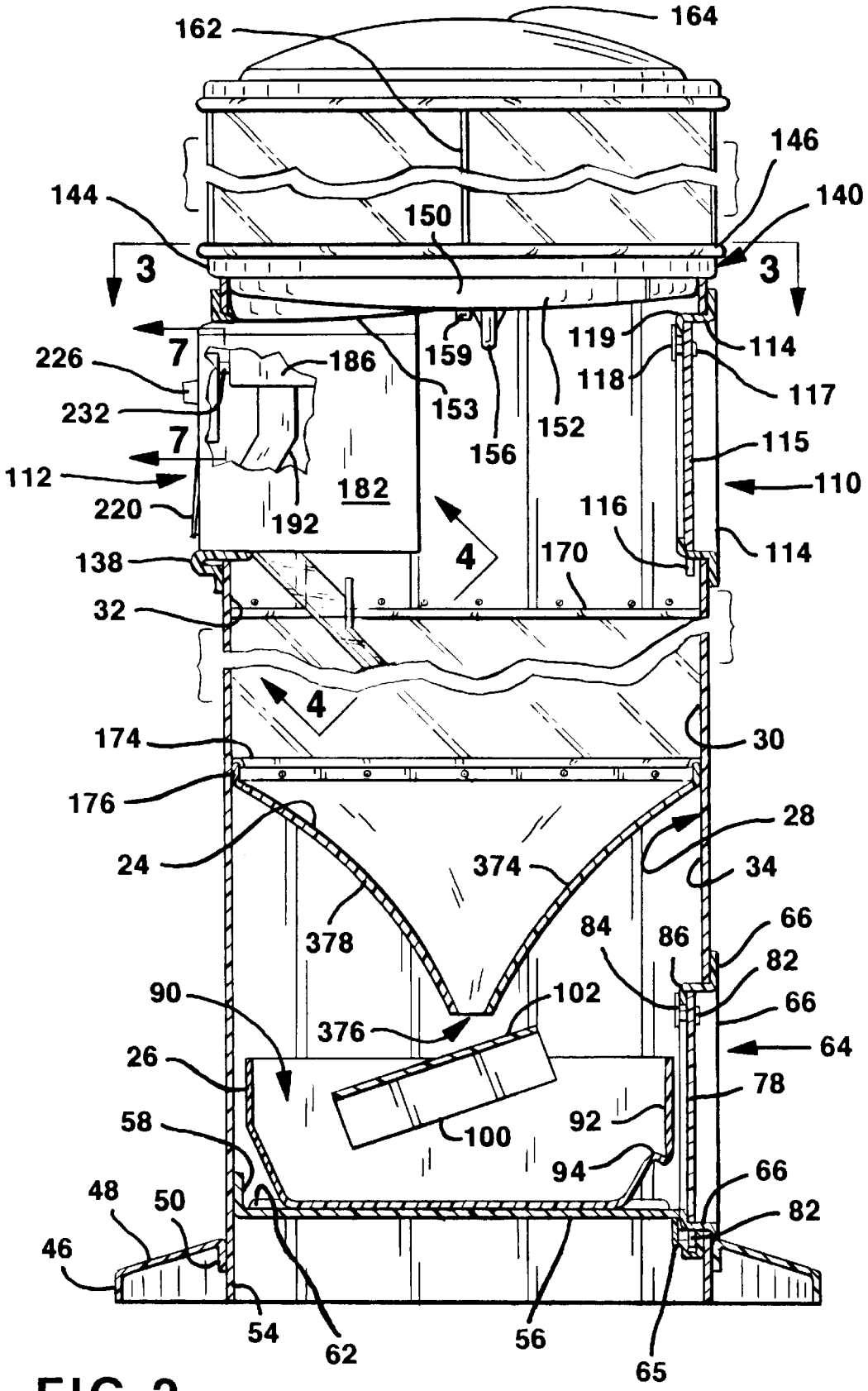
FIG. 2 shows a section view of the vending machine of FIG. 1.

As shown in FIG. 1, the present aerobatic coin collecting apparatus or vending machine 10 includes a housing 12 mounted on a base 14. A canister 16 having a plurality of articles 18 to be dispensed is mounted on the housing 12. A coin feed mechanism 20 is fixed to the housing 12 and dispenses at least one of the articles 18 in exchange for a coin being fed into the mechanism 20. From the coin feed mechanism 20, a coin 21 drops into a main chute 22 fixed in the housing 12. The main chute 22 guides the coin 21 onto a vortex structure or gravity well 24 fixed in the housing 12. From the vortex structure 24, the coin 21 falls into a coin box or container 26 (shown in FIG. 2).

More specifically, the housing 12 is formed from a flat piece of a clear or transparent material such as polycarbonate, acrylic, or PETG. Material which is preferred is material which is clear or transparent, relatively light, may be rollable with or without the application of heat into a cylinder, can be cleaned easily with ordinary household chemicals, and permits the application of a design or color to one surface. Even glass may be used.

Prior to being formed or rolled into its cylindrical shape, a design or color is applied to the designated inner surface 28 of the housing 12. Any design or color may be applied. A preferred aesthetic application is to mask a middle portion 30 of the inner surface 28 and apply paint to upper and lower portions 32 and 34 of the inner surface 28 of the housing 12. Preferred methods of painting the design or color include spray painting or application by brush. A more preferred method is silk screening the design or color. One preferred color combination is the application of a solid color, such as red, to the inner surface, with a subsequent application of a white paint to the red coat to provide opacity to the red coat.

After the application of a design or color to the inner surface 28, the flat sheet is rolled and permanently fixed in a rolled or cylindrical form by a double-channeled strip 36. Each of opposite elongate edges of the flat sheet are fed into one of the channels and held with rivets extending through the double channeled strip 36 and respective edge portions of the flat sheet. The double-channeled strip 36 extends the height of the housing 12.

The housing 12 is riveted to the base 14, which is a molded piece of plastic with a first outer cylindrical portion 46, a tapering portion 48, and a second inner cylindrical portion 50. The second inner cylindrical portion is riveted to a lower portion of housing 12. A lower edge 54 of the housing 12 is preferably spaced from the floor such that the base portion 46 rests on a floor or surface to support the housing 12.

Slightly upwardly from the base 14 is fixed in the housing 12 a floor or platform 56 for sealing one end of the cylindrical housing 12 and for supporting the coin box 26. The platform 56 includes an annulus portion 58 which is riveted to the housing 12. The platform 56 further includes a pair of ridges or guides 62 integrally formed therein on either side ofthe coin box 26 for slidingly guiding the coin box 26 into and out of the housing 12 via a generally square opening 64 formed in or cut out of the housing 12. The annulus portion 56 terminates on each side of the opening 64. The platform 56 further includes a receptacle 65.

A guard or door frame 66 forming the square opening 64 is riveted to side portions of the housing 12. The guard frame 66 is further riveted to the platform 56. The guard frame 66 further includes a pair of slots (not shown) communicating with the stepped receptacle 64.

A metal guard plate or locked door 78 is lockable to the frame 66 via a pair of integral tabs 80 extending downwardly through the slots and terminating in the stepped receptacle 65. A lock for the metal guard plate or door includes a first portion 82 having a keyhole and a metal bar 84 which may be turned up by a key to engage an integral lip 86 of the door frame 66.

The coin box or container 26, which is set on the platform 56 between the ridges or guides 62, catches and stores coins 21 falling from the vortex structure 24. The coin box 26 is generally a parallelepiped structure with an open top 90. One end 92 of the coin box 26 includes a grip 94 to facilitate insertion and removal of the coin box 26 from the housing 12 through the opening 64.

The coin box 26 includes a baffle 100 between the vortex structure 24 and the coin box 26. The baffle 100 is opaque and is of a sufficient width and length relative the outlet of the vortex such that the interior of the coin box 26 cannot be viewed, via the outlet of the vortex structure, through the clear middle portion 30 of the housing 12. The baffle 100 includes an upper inclined surface 102 leading into an interior of the coin box 26 such that coins 21 falling from the vortex structure 24 slide or are deflected into the coin box 26. It can be appreciated that the baffle 100 may be fixed to the housing 12 or to the vortex structure 26, or the baffle 100 may be supported by the platform 56. Further, the baffle 100 may take the shape of an inverted cone, with the tip of the cone being disposed adjacent to the outlet of the vortex structure 24. It should be noted that the baffle 100 may be fixed at its inclined orientation via pin connectors such as screws or rivets.

The upper end of the housing 12 includes a pair of generally square openings 110, 112 opposite one another. Opening 110 is on the same side of housing 12 as opening 64 and includes a guard or door frame 114 identical to guard or door frame 66. Frame 114 is riveted to housing 12. The guard frame 114 includes a pair of slots (not shown). A metal guard plate or locked door 115 is lockable to the frame 114 via a pair of integral tabs 116 extending downwardly through the slots. A lock for the metal guard plate or door includes a first portion 117 having a keyhole and a metal bar 118 which may be turned up by a key to engage an integral lip 119 of the door frame 114. The plate 115 permits access through opening 110. Opening 110 is at least hand sized to permit access by a hand and arm into the housing 12, such as for adjustment of the chute 22.

Opening 112 permits a mounting of the coin feed mechanism 20. Opening 112 is defined by a frame 130 formed of a molded plastic and fixed to the housing 12 via rivets. Frame 130 includes an integral front rounded portion 134 conforming to the cylindrical housing 12 and integral inwardly extending flat edges 136 confronting the sides of the casing of the coin feed mechanism 20 for mounting the coin feed mechanism 20. Frame 130 further includes a balcony 138 extending from or tangential to the housing 12 for aesthetically setting off the exit for the article 18.

The upper end of the housing 12 is sealed with a disk-like molded plastic piece or sloped gumball platform 140 to an upper edge portion of the housing 12. Gumball platform 140 includes an outer annulus portion 144 with a relatively sharp continuous edge covered for safety and aesthetic purposes with a plastic U-shaped silver guard 146. A rim 148 extends inwardly at a right angle from the annulus portion 144 for supporting the perimeter of the gumball canister 16. An inner annulus portion 150 extends downwardly relative to the rim 148, and a floor portion 152 slopes downwardly and inwardly from the inner annulus portion 150. The floor portion 152 includes a still further sloping portion 153 leading downwardly such that even the last remaining gumball is fed from the platform 140. The floor portion 152 includes a strip 156 of a hardened or more rigid plastic set in a slot 158 integrally molded into the gumball platform 140. The weight of the gumballs 18 or other article may exceed 100 pounds and the rigid strip 156 minimizes the chances of the floor portion 152 bending or breaking under such weight. The floor portion 152 further includes a receptacle 159 formed centrally therein for receiving a nut 160 for fixing one end of a rod 162 therein. The other end of such rod may be fixed to a removable top 164 of the canister 16. Top 164 is removable to permit the gumballs 18 or other article to be dumped into the canister 16.

The housing 12 further includes an upper silver colored, U-shaped guard 170 wound about the inner surface 28 of the housing 12 adjacent to bottom edge of the upper design or color portion 32 for aesthetic purposes. The guard 170 is riveted to the housing 12. A lower silver colored, U-shaped guard 174 balances the upper guard 170 and is placed about an upper annular edge 176 of the vortex structure 24.

Figure 3:
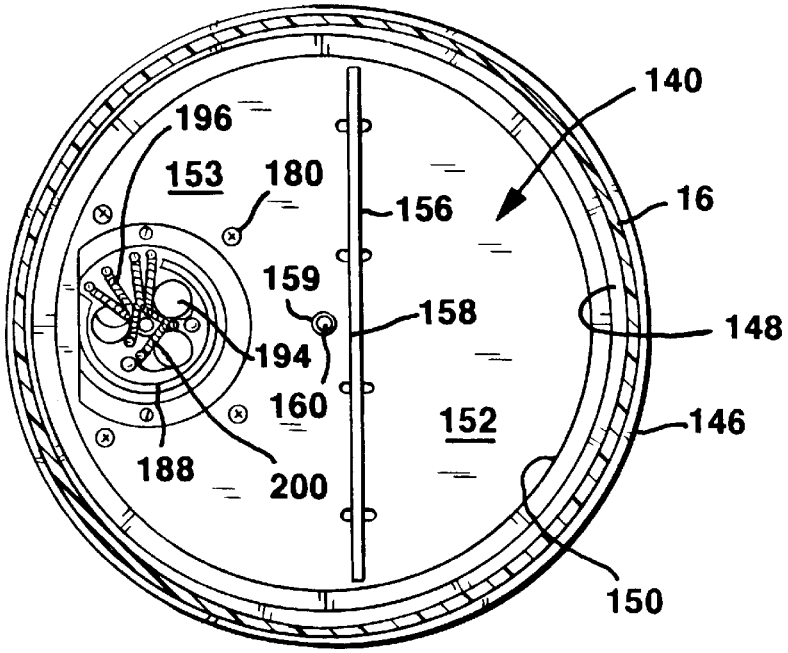
FIG. 3 shows a section view at lines 3—3 of FIG. 2.
Figure 4:
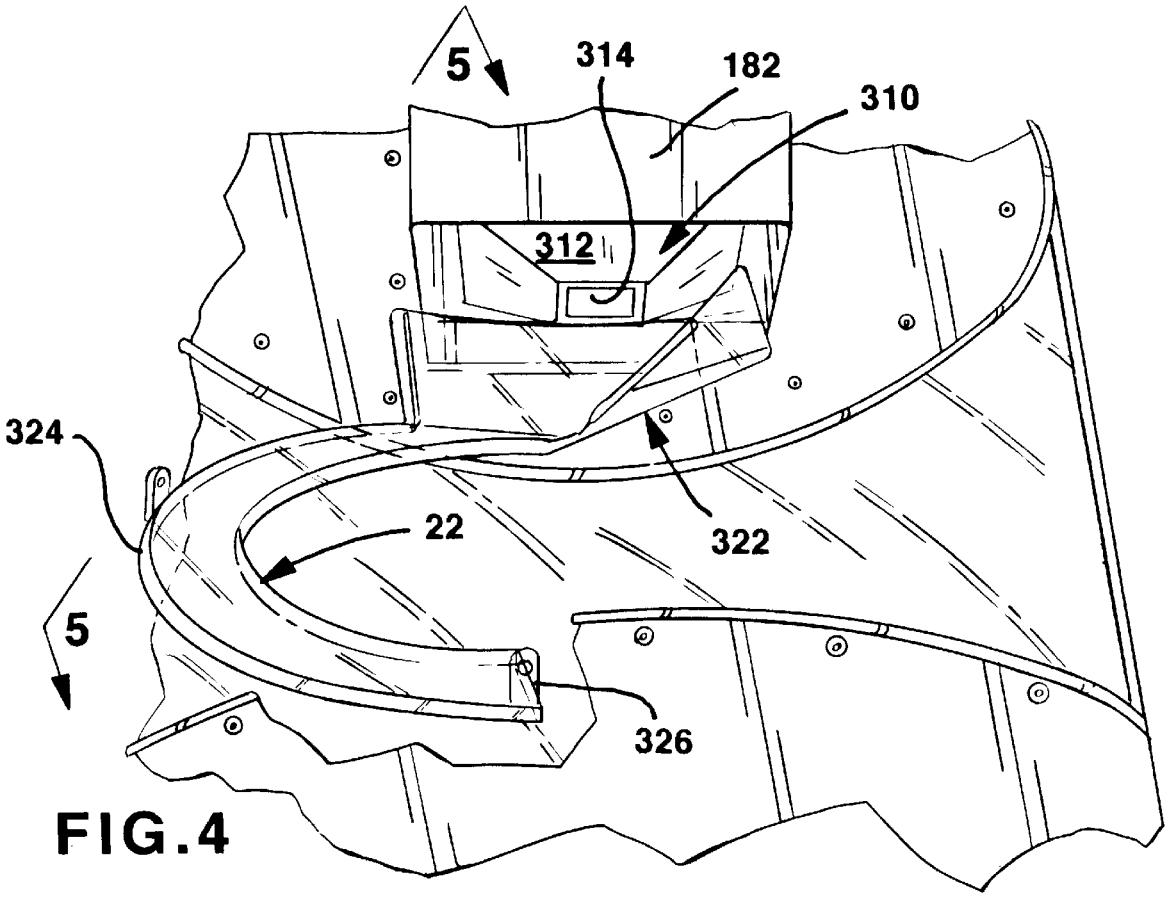
FIG. 4 shows a section view at lines 4—4 of FIG. 2.
Figure 5:
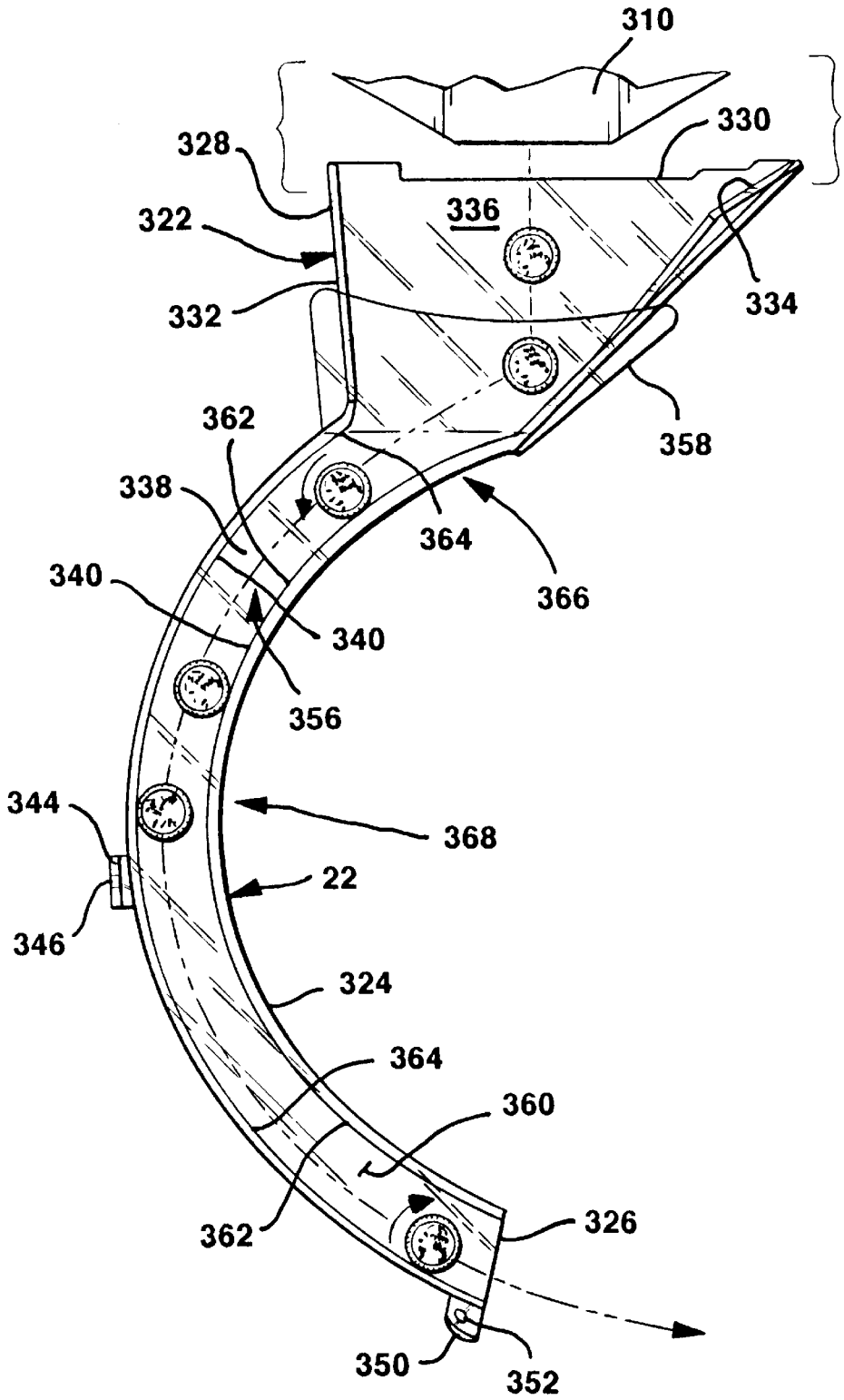
FIG. 5 shows a view of the chute at lines 5—5 of FIG. 4.

The coin feed mechanism 20 is fixed via screws 180 to the underside of the floor portion 152. The coin feed mechanism 20 includes a generally cubicle casing 182. The casing 182 includes a disk mounting portion 186 for rotatably mounting a disk 188 therein. A gumball outlet 192 extends from the disk mounting portion 186. The disk 188 includes three gumball through holes 194 formed therein for communication in turn with the gumball outlet 192. A set of four rigid coil springs 196 are fixed to casing 182 over the hole 194 in communication with outlet 192 to prevent gumballs or articles 18 to roll continuously out of the gumball machine 10. As the disk 188 rotates away from the springs 196 (such as is indicated in FIG. 3), the empty hole 194 is exposed to the gumballs 18 and filled by one of the gumballs 18 rolling therein. During such rotation, another hole 194, having a gumball 18 therein, rotates under the springs 196 to be aligned with gumball outlet 192 and to thereby release its gumball 18 through the gumball outlet 192. Obliquely extending springs 200 are fixed at one end via respective screws or pin connectors to the rotating disk 188 to stir up the gumballs 18 when the disk 188 is rotated. Gumballs or other candy may somewhat stick to each other and form self-supporting bridges over the holes 194 in hot environments and a stirring action may break down such bridges. The disk 188 further includes gear teeth on its circumference.

The coin feed mechanism 20 includes a swingable flap 220 for closing off the gumball outlet 192. The flap 220 has a weight greater than the weight of the gumball or article 18 to prevent the gumball or article 18 from forcing open the flap 220.

Figure 7:
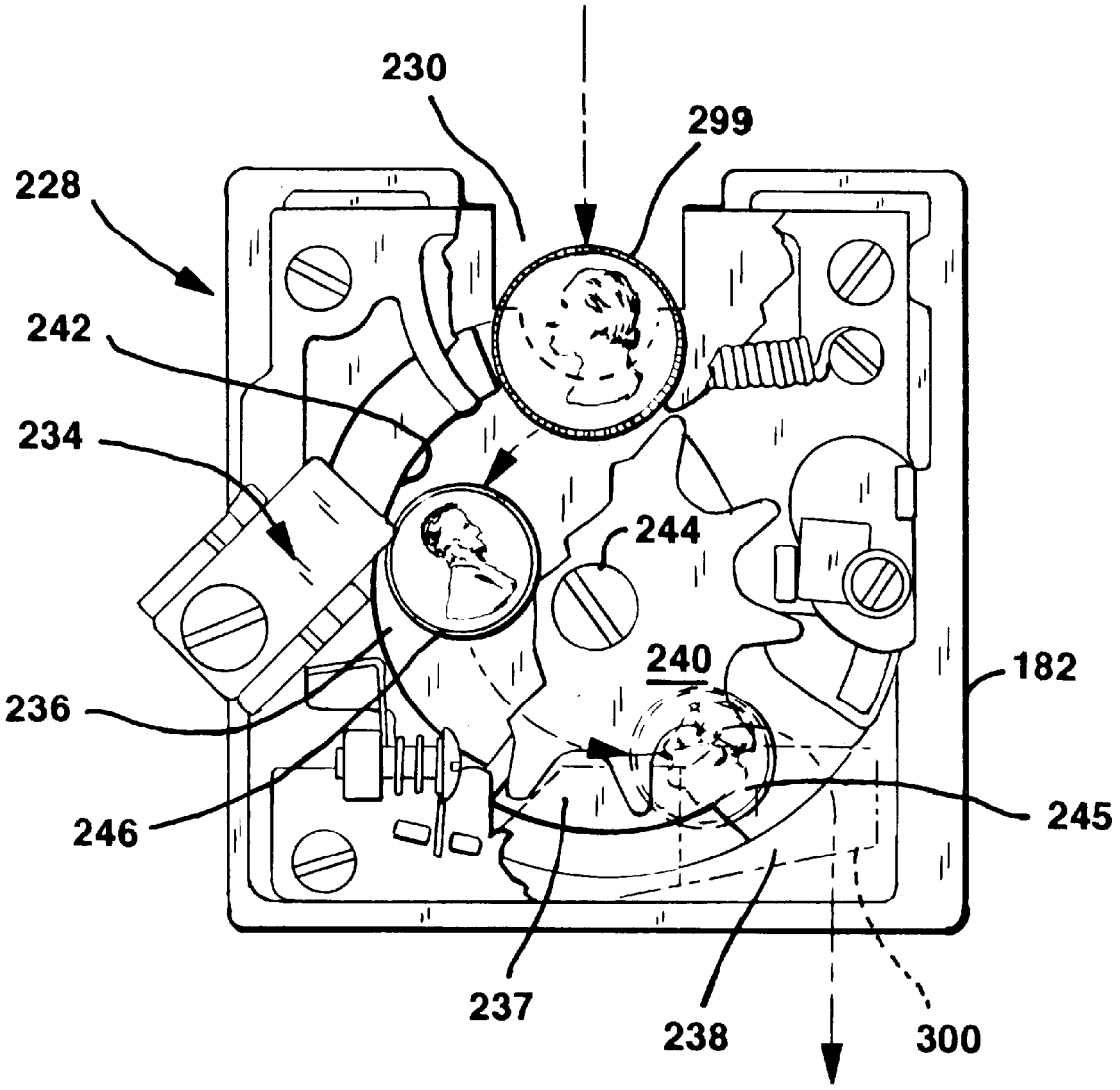
FIG. 7 shows a view at lines 7—7 of FIG. 2.

The turning of the disk 188 is accomplished by the turning of knob 226, which is permitted by a mechanism 228 (FIG. 7) which responds to a coin, such as a quarter, being fed into a coin inlet 230. The knob 226 is rigidly fixed to a toothed gear 232 which in turn engages disk 188, and a complete 360 degree turn by the knob 226 rotates the disk 188 for 120 degrees such that one of the holes 194 having a gumball 18 is turned into alignment with the gumball outlet 192. A coin control arrangement 234 is disposed between the knob 226 and toothed gear 232. The coin control arrangement 234 includes a coin passage 236 having the coin inlet 230 and a coin outlet 238. The depth of the passage 236 is bounded on one side by a coin control plate 237 and on the other side by a portion of a back plate 240. The width of the passage 236 is bounded by a rounded outer edge 242 of plate 237 and the knob pin connector 244 inwardly of the outer edge 242. The depth of the passage 236 is of sufficient size to accept coins such as a dime 245, nickel, or penny 246, which have a thickness about equal to or less than the thickness of a quarter. The width of the passage 236 is of sufficient size to accept coins such as the dime 245, nickel, or penny 246, which have a diameter less than the diameter of a quarter. Accordingly, the feeding of a dime, nickel, or penny in coin inlet 230 results in the dropping of such coin, under the influence of gravity, through coin passage 236 and out of coin inlet 238. Since such a coin falls through the passage 236, such a coin cannot remain in coin inlet 230, and does not permit the knob 226 to be fully turned and hence does not permit the triggering of mechanism 228. Thus a gumball or article 18 does not fall through chute 192, yet one enjoys watching a penny, dime, or nickel roll in the vortex structure 24 without ajamming of the coin mechanism 228. In other words, the coin feed mechanism 20 has a drop through feature.

A quarter 299, however, remains in coin inlet 230 since the quarter has a diameter greater than the width of the passage 236. When the knob 226 is turned, the mechanism 228 recognizes the quarter 299 and permits the knob 226 to be fully turned, thereby turning the disk 188.

An anti-stacking plate 300 extends over the coin outlet 238 of the coin passage 236 to feed the coin away from mechanism 228 to prevent jamming thereof. It should be noted that when a quarter is fed into the inlet 230 and the knob 226 is fully turned, the quarter exits at about the same place as the where the coin outlet 238 of the coin passage 236 is positioned when the knob 226 is at rest. Hence the anti-stacking plate 300 also keeps quarters away from mechanism 228.

As to the coin feed mechanism 20 as a whole and as to its coin drop through features in particular, the Kovens U.S. Pat. No. 5,111,928 is hereby incorporated by reference in its entirety.

A coin pre-chute or fimnel-like positioner 310 is fixed to a bottom portion of casing 182. The funnel-like positioner 310 includes four downwardly and inwardly extending floor portions 312 leading into a centrally disposed square opening or outlet 314. Opening 314 is preferably offset slightly from a position underneath the coin exit 238 of mechanism 228 such that a coin 21 which is fed into the coin mechanism 20 first falls or flops from coin exit 238 onto one or more of the floor portions 312 (instead of falling directly through the opening 314) and then slides down such floor portion or portions 312 and falls out of the positioner 310 via the opening or outlet 314. However, if desired, opening 314 maybe disposed directly under coin exit 238.

The coin 21 then falls into the main chute or guide 22. The main chute or guide 22 generally includes a mouth or coin inlet 322, and a slotted passage 324 having a coin outlet 326. The chute 22 is generally formed of two pieces. A first base piece 328 includes a funnel or mouth portion 330 having opposing obliquely oriented sidewall portions 332, 334 leading inwardly and downwardly toward one another. The sidewall portions 332, 334 are integral with an inwardly and downwardly extending sidewall portion 336. Sidewall portions 332 and 334 (or a sidewall 332 and a corner portion of sidewalls 334 and 336) may be resiliently expanded over the outer faces of inwardly extending sides 136 of frame 130 for the coin feed mechanism 20 to hold the mouth 322 positioned under the pre-chute opening or outlet 314. Or if desired, one or more of the sidewall portions 332, 334, 336 may be riveted to the housing 12 or to a portion of the housing 12 such asthe sides 136 of frame 130.

The sidewall portions 332, 334 and 336 are integral with a slide portion 338 having integral flanges 340. A first tab 344 extends integrally from a middle portion of the slide portion 338 and includes an opening 346 for accepting a rivet for fixing the chute 22 to the housing 12. A second tab 350 extends integrally from an end portion of the slide portion 338 near outlet 326. Tab 350 includes a hole 352 for receiving a rivet for fixing the chute 22 to the housing 12.

A second piece 356 forming the chute 22 includes a generally trapezoidal, sidewall portion 358 for forming the mouth 322 along with sidewall portions 332, 334, and 336. It should be noted that mouth 322 forms an opening greater in size than opening 314 and is positioned generally directly below opening 314.

Sidewall portion 358 tapers into an elongate, curved, flat strip 360 which is fixed, such as by gluing, to lips extending from the flanges 340 of the first piece 328 to close off and form the chute 22.

It can be appreciated that the first and second pieces 328 and 356, or the chute 22 as a whole, form first and second track or channel portions 362 and 364. In other words, the slotted passage or chute 22 includes two track portions opposing each other. First track or channel portion 362 is formed by one of the flanges 340 (and an adjacent elongate strip portion of the slide base portion 338 and an adjacent elongate strip portion of flat strip 360) and the second track or channel portion 364 is formed by the other of the flanges 340 (and an adjacent elongate strip portion of the slide base portion 338 and an adjacent elongate strip portion of flat strip 360). Under the influence of gravity, a coin 21 first falls onto track portion 362 at an area generally designated by reference numeral 366 adjacent to the mouth 322. Subsequently, after rolling down track portion 362, the coin 21 falls at an area generally designated by reference numeral 368 under the influence of gravity to the second track or channe portion 364. The coin 21 then rolls down the second track portion 364 and exits the outlet 326.

It can be appreciated that each of the incremental sections of the first track portion 362 is disposed at a lower height than respective directly opposing and adjacent incremental sections of second track portion 364 at the mouth or inlet 322 and that each of the incremental sections of the second track portion 364 is disposed at a lower height than respective directly opposing and adjacent incremental sections of the first track portion 362 at the outlet 326. Hence the coin 21 is transferred from one track portion to the other track portion somewhere between the coin inlet 322 and the coin outlet 326. Such results in the axial roll of the coin changing directions from one track portion to the other track portion.

It can be appreciated that the chute 22 is curved or formed in the nature of a switchback from the mouth 322 to the outlet 326. It can furter be appreciated that the chute portion 368 (the chute 22 without the mouth 322) is generally planar, and that such a plane is positioned neither vertically nor horizontally, but obliquely in the housing 12.

It can further be appreciated that the chute 22 regulates the speed of the coin. It is preferred that the coin travel neither too fast nor too slow. A coin traveling too fast may make less than one trip about the vortex structure 24 because such a coin returns to hit the coin outlet 326 of the chute 22, and then flops down and out of the vortex structure 24. A coin traveling too slow may flop immediately out of the coin outlet 326 and out of the vortex structure 24. A coin traveling at a rate in the preferred range loses a sufficient amount of altitude on its first trip about the vortex 24 to miss the chute outlet 326 but maintains a sufficient amount of speed and altitude to make a maximum number of trips about the vortex 24 to provide a relatively great amount of entertainment. It can be appreciated that the chute 22 is designed so as to regulate the speed for different coins, such as a quarter, penny, nickel, or dime.

Figure 6:
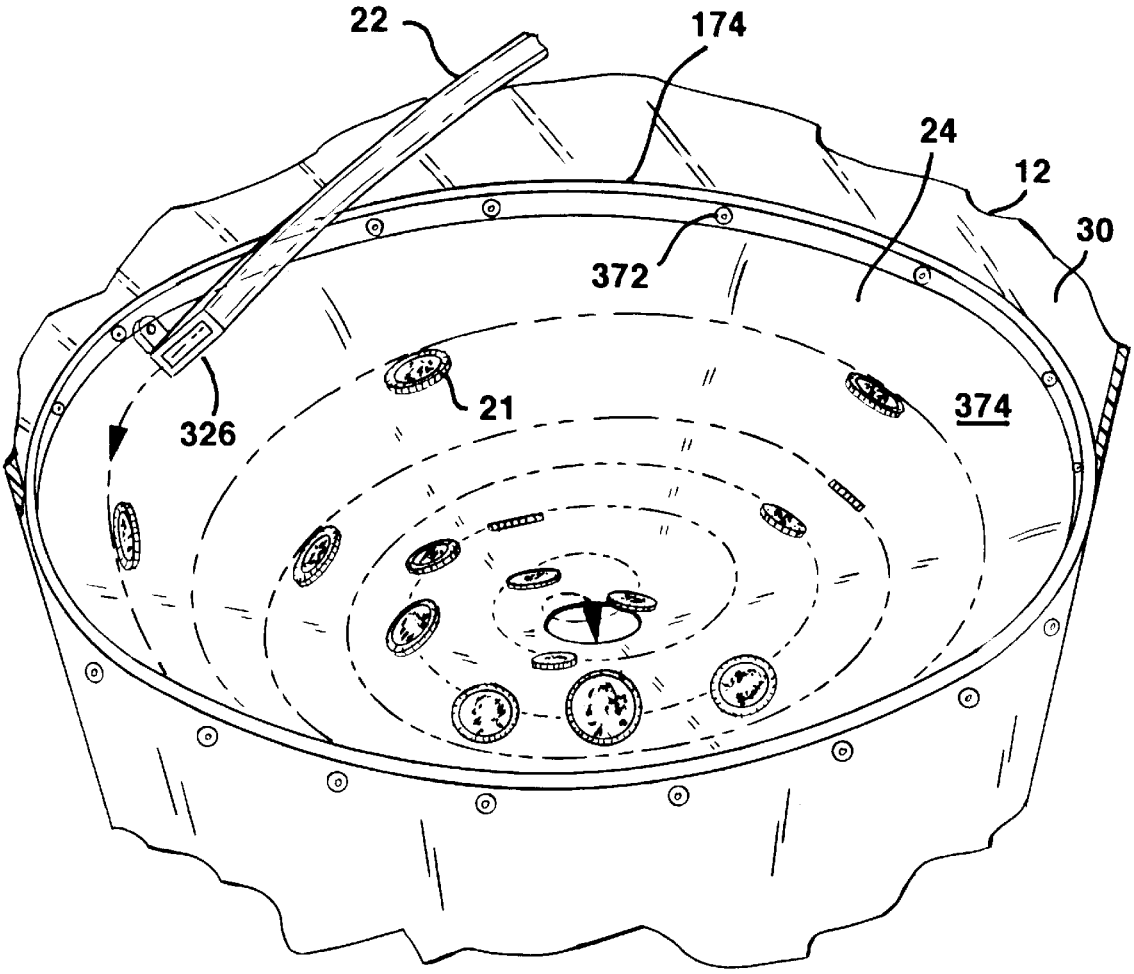
FIG. 6 shows a perspective view of the vortex of the vending machine of FIG. 1.

It can be appreciated that the chute 22 may be oriented so as to make the coin run clockwise or counter-clockwise about the vortex structure 24. A counter-clockwise running is shown in FIG. 6. A clockwise runing is preferred at latitudes "above" the equator, such as in North America, since at such latitudes a coin may run about the vortex structure 24 at a greater rate of speed with such a clockwise running.

From the coin outlet 326, the coin 21 rolls at generally a right angle onto the surface of vortex structure 24. Vortex structure 24 includes the integral, endless cylindrical lip 176 on which the U-shaped guard 174 is fixed. This endless lip 176 is affixed via rivets 372 to the housing 12 to fix the vortex structure 24 to the housing 12. From the lip 370, the vortex structure 24 includes a coin rolling surface 374 having a slope, relative to the horizontal, which increases from the lip 176 to a coin outlet 376. In other words, at the surface 374 near the lip 370, the slope of the surface 374 is relatively slight; such surface 374 near the lip 370 is almost horizontal. At the surface 374 near the vortex outlet 376, the slope of the surface 374 is relatively great; such surface 374 near the outlet 376 is almost vertical. If desired, the slope of the coin rolling surface 374 from the lip 176 to the coin outlet 376 may increase ever more continuously.

The coin 21 rolls in a general spiral direction as it traverses the vortex surface 374, and appears to gain speed as it rolls closer and closer to the outlet 376. It can be appreciated the coin outlet 326 of the chute 22 is oriented at a right angle relative to the vortex surface 374 near the lip 370, and this right angle roll of the coin 21 is maintained by the coin 21 even as the coin 21 traverses the nearly vertical area near the vortex outlet 376 such that the coin 21 is disposed in an almost horizontal orientation.

The vortex structure 24 is formed from a clear or transparent material Such material may be polycarbonate, Lexan, PETG, acrylic, glass or any other clear or transparent material, Plastic materials such as polycarbonate, Lexan, PETG, and acrylic is preferred. Polycarbonate is most preferred. Such material is initially in a flat disk form and then is shaped in a mold to the vortex form. An outer surface 378 of the vortex structure 24 is then coated with a paint or dye to provide an aesthetic effect to the surface 378. Preferably, the silk-screen painting method is used to apply a design or color coat to the outer surface 378. Preferably the coat is a solid colored coat such as red with a coat of white paint on top of the coat of red paint to lend opacity to the red color. By forming the vortex structure 24 from a clear material and by applying a color or design to the outer surface 378 opposite of the surface 374 on which the coin 21 rolls, the color or design is spared the damaging effects of a dirty, serrated coin such as a quarter but the color or design is visible through the clear vortex structure 24 to lend an aesthetic effect to the vortex structure 24. It should be noted that to one viewing the vortex structure 24 (either close-up or from outside of the housing 12), the vortex structure 24 has the appearance of piece which is colored or includes a dye from one surface 374 to its opposing surface 378 when in actuality the color or dye is applied only to the outer surface 378.

In operation, a coin 21 suited for the coin feed mechanism 20 (such as a quarter) is fed into the coin inlet 230. The knob 226 is then turned, and a gumball 18 is received in the outlet 192 against flap 220. Concurrently, the mechanism 20 drops the coin 21 into the pre-chute 310 which centers the coin 21 over the mouth 322 of the main chute 22. The coin 21 falls through the opening 314 of the pre-chute 310, into the mouth 322 of the main chute 22, rolls on the first track portion 362, switches under the influence of gravity to the other side of the main chute 22, specifically second track portion 364, and then rolls onto the vortex surface 374. The coin 21 rolls on the vortex surface 374 in a spiral fashion, slowly gains speed, and then drops out of the outlet 376 and into the coin box 26 via the baffle 100. If desired, coins of a size smaller than the suited size (such as a dime, nickel, or penny) may be fed into the coin inlet 230 of the coin feed mechanism 20 without damaging the mechanism 20. Such coins simply fall through the mechanism 20 and into the pre-chute 310, and then are further drawn under the influence of gravity to the mouth 322, main chute 22, vortex surface 374, and coin box 26.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A vending machine, comprising, in combination:

a) a housing;

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a chute engaged in the housing between the coin feed mechanism and the coin receptacle and visible via the transparent portion for guiding the coin from the coin feed mechanism at least partially under the influence of gravity, wherein the chute comprises a coin inlet and coin outlet, with the coin inlet being disposed relatively adjacent to the coin feed mechanism, and wherein the chute further comprises a switchback between the coin inlet and the coin outlet;

g) a trackless and endless structure engaged in the housing between the coin feed mechanism and the coin receptacle and visible via the transparent portion for guiding the coin at least partially from the chute to the coin receptacle at least partially under the influence of gravity, with the coin outlet of the chute being relatively adjacent to the trackless and endless structure and dispensing the coin into the trackless and endless portion, and wherein the trackless and endless structure comprises a vortex portion between the chute and the coin receptacle, with the coin spirally engaging the vortex portion; and h) wherein the coin is fed into the coin feed mechanism, then is guided by the chute from the coin feed mechanism to the vortex portion, then spirally engages the vortex portion, then drops into the coin receptacle for storage.

2. The vending machine of claim 1 wherein the chute includes a curved portion extending obliquely between the coin feed mechanism and the trackless and endless structure.

3. The vending machine of claim 1 wherein the coin inlet of the chute comprises a mouth having an open area greater than an open area of the coin outlet of the chute.

4. The vending machine of claim 1 wherein the transparent portion includes a perimeter and wherein at least a portion of the chute runs adjacent to the perimeter such that the coin is visible through the transparent portion and is relatively close to one viewing the coin.

5. The vending machine of claim 1 wherein at least a portion of the chute is transparent such that the coin is visible when in such portion of the chute.

6. The vending machine of claim 1 and further comprising a pre-chute between the coin feed mechanism and the chute, with the chute having a coin inlet, and with the pre-chute having an inclined portion with an opening disposed over the coin inlet of the chute for positioning the coin over the chute such that the coin falls under the influence of gravity from the opening to the chute.

7. The vending machine of claim 1 wherein the vortex portion includes proximal and distal end portions such that the coin rolls from the proximal end portion to the distal end portion, with the vortex portion having a slope relative to the horizontal, with the slope of the vortex portion continuously increasing from the proximal end portion to the distal end portion.

8. The vending machine of claim 7 wherein the slope of the vortex portion continuously increases ever more from the proximal end portion to the distal end portion.

9. The vending machine of claim 1 wherein the vortex portion comprising a transparent material having first and second opposing surfaces, with the first surface comprising a vortex surface on which the coins roll, and with the second surface comprising a colored coat such that the vortex portion appears to be colored through the transparent material and such that aesthetic life of the vortex portion is maximized.

10. A vending machine, comprising, in combination:

a) a housing;

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a chute engaged in the housing between the coin feed mechanism and the coin receptacle and visible via the transparent portion for guiding the coin from the coin feed mechanism at least partially under the influence of gravity with the chute comprising a coin inlet and coin outlet, with the coin inlet being disposed relatively adjacent to the coin feed mechanism;

g) a trackless and endless structure engaged in the housing between the coin feed mechanism and the coin receptacle and visible via the transparent portion for guiding the coin at least partially from the chute to the coin receptacle at least partially under the influence of gravity, with the coin outlet being disposed relatively adjacent to the trackless and endless structure; and h) wherein the chute comprises an elongate slot formed by a pair of first and second elongate track portions disposed opposite each other, with incremental sections of the first track portion being disposed below respective adjacent incremental sections of the second track portion at the coin inlet and with incremental sections of the second track portion being disposed below respective adjacent incremental sections of the first track portion at the coin outlet, with the second track portion being disposed closer to the trackless and endless structure at the coin outlet than the first track portion such that the coin engages the first track portion near the coin inlet, such that the coin is drawn under the influence of gravity to drop to the second track portion between the coin inlet and coin outlet, and such that the coin engages the second track portion near the coin outlet.

11. A vending machine, comprising, in combination:

a) a housing;

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a chute engaged in the housing between the coin feed mechanism and the coin receptacle and visible via the transparent portion for guiding the coin from the coin feed mechanism at least partially under the influence of gravity with the chute comprising a coin inlet and coin outlet with the coin inlet being disposed relatively adjacent to the coin feed mechanism;

g) a trackless and endless structure engaged in the housing between the coin feed mechanism and the coin receptacle and visible via the transparent portion for guiding the coin at least partially from the chute to the coin receptacle at least partially under the influence of gravity with the coin outlet being disposed relatively adjacent to the trackless and endless structure; and h) wherein the chute comprises first and second track portions, with the first track portion extending from the coin inlet and with the second track portion leading into the coin outlet, with the coin being drawn at least partially under the influence of gravity from the first track portion to the second track portion, with the first and second track portions forming a switchback such that axial roll of the coin is in one direction in the first track portion and in the other direction in the second track portion.

12. A vending machine. comprising, in combination:

a) a housing;

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a chute engaged in the housing between the coin feed mechanism and the coin receptacle and visible via the transparent portion for guiding the coin from the coin feed mechanism at least partially under the influence of gravity, wherein the chute comprises a coin inlet and coin outlet, with the coin inlet being disposed relatively adjacent to the coin feed mechanism;

g) a trackless and endless structure engaged in the housing between the coin feed mechanism and the coin receptacle and visible via the transparent portion for guiding the coin at least partially from the chute to the coin receptacle at least partially under the influence of gravity, with the coin outlet of the chute being relatively adjacent to the trackless and endless structure and dispensing the coin into the trackless and endless portion, and wherein the trackless and endless structure comprises a vortex portion between the chute and the coin receptacle with the coin spirally engaging the vortex portion;

h) wherein the coin is fed into the coin feed mechanism, then is guided by the chute from the coin feed mechanism to the vortex portion, then spirally engages the vortex portion, then drops into the coin receptacle for storage; and g) wherein the coin feed mechanism comprises a slot of a pre-defined size for a pre-defined coin, with the slot being of a sufficiently great size to permit coins having a lesser size to pass therethrough without operating the coin feed mechanism whereby coins such as pennies may be fed through the coin feed mechanism without an article being dispensed such that coins such as pennies may be observed traveling the chute and the trackless and endless portion without clogging the coin feed mechanism.

13. A vending machine, comprising, in combination:

a) a housing:

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a chute engaged in the housing between the coin feed mechanism and the coin receptacle and visible via the transparent portion for guiding the coin from the coin feed mechanism at least partially under the influence of gravity wherein the chute comprises a coin inlet and coin outlet, with the coin inlet being disposed relatively adjacent to the coin feed mechanism;

g) a trackless and endless structure engaged in the housing between the coin feed mechanism and the coin receptacle and visible via the transparent portion for guiding the coin at least partially from the chute to the coin receptacle at least partially under the influence of gravity, with the coin outlet of the chute being relatively adjacent to the trackless and endless structure and dispensing the coin into the trackless and endless portion, and wherein the trackless and endless structure comprises a vortex portion between the chute and the coin receptacle, with the coin spirally engaging the vortex portion;

h) wherein the coin is fed into the coin feed mechanism, then is guided by the chute from the coin feed mechanism to the vortex portion then spirally engages the vortex portion then drops into the coin receptacle for storage; and g) wherein the trackless and endless structure comprises an open distal end portion relatively adjacent to the coin receptacle, with the open distal end portion being formed by an endless edge having an axis, and wherein the coin receptacle comprises an interior, and further comprising a generally opaque piece engaged between the coin receptacle and the trackless and endless structure and adjacent to the open distal end portion, with the opaque piece running from the axis of the endless edge to beyond the endless edge such that the opaque piece hides the interior of the coin receptacle for minimizing the chances of the coins in an overloaded coin receptacle being visible via the transparent portion.

14. The vending machine of claim 13 wherein the opaque piece includes an inclined surface portion for permitting a coin to slide under the influence of gravity into the coin receptacle.

15. A vending machine, comprising, in combination:

a) a housing;

b) a canister engaged with the housing for storing a plurality of articles;

c) a coin feed mechanism engaged with the housing for dispensing at least one of the articles from the canister in exchange for at least one coin being fed into the coin feed mechanism;

d) a coin receptacle engaged with the housing for receiving and storing the coin after the coin has been fed into the coin feed mechanism;

e) a transparent portion engaged with the housing between the coin feed mechanism and the coin receptacle;

f) a track portion and a trackless portion in the housing between the coin feed mechanism and the coin receptacle for engaging the coin, with the track and trackless portion being visible via the transparent portion, with the coin being drawn along the track and trackless portions and from the coin feed mechanism to the coin receptacle at least partially under the influence of gravity; and g) wherein the track portion comprises a coin inlet and a coin outlet, with the coin inlet being disposed relatively adjacent to the coin feed mechanism, with the coin outlet being disposed relatively adjacent to the trackless portion, with the track portion further comprising a curved portion extending obliquely between the coin feed mechanism and the trackless portion;

h) wherein the trackless portion comprises a vortex portion between the coin outlet of the track portion and the coin receptacle, with the coin spirally engaging the vortex portion; and i) wherein the coin feed mechanism comprises a slot of a pre-defined size for a predefined coin, with the slot being of a sufficiently great size to permit coins having a lesser size to pass therethrough without operating the coin feed mechanism whereby coins such as pennies may be fed through the coin feed mechanism without an article being dispensed such that coins such as pennies may be observed traveling the track portion and the vortex portion without clogging the coin feed mechanism.

16. A vending machine method, with the vending machine having a plurality of articles, a first track portion, a second track portion and a trackless portion, comprising in combination:

a) feeding a coin into the vending machine such that the coin is irretrievable without unlocking the vending machine and receiving at least one article in exchange for the coin; then b) dropping the coin into the first track portion; then c) rolling the coin down the first track portion in one axial roll direction of the coin under the influence of gravity then rolling the coin down the second track portion in the other axial roll direction under the influence of gravity; then d) rolling the coin in a spiral direction down the trackless portion under the influence of gravity; and then e) catching the coin.

17. The method of claim 16 and further comprising the step of dropping the coin into a second track portion after the step of rolling the coin down the first track portion.

* * * * *